United States Patent [19]

Sato et al.

[11] Patent Number: 4,809,768

[45] Date of Patent: Mar. 7, 1989

[54] COOLING ROLLS FOR PRODUCING RAPIDLY SOLIDIFIED METAL STRIP SHEETS

[75] Inventors: Toru Sato; Nobuyuki Morito; Shinji Kobayashi, all of Chiba, Japan

[73] Assignee: Kawasaki Steel Corporation, Kobe, Japan

[21] Appl. No.: 89,527

[22] Filed: Aug. 26, 1987

[30] Foreign Application Priority Data

Sep. 6, 1986 [JP] Japan ..... 61-208854

[51] Int. Cl.[4] ..... B22D 11/06

[52] U.S. Cl. ..... 164/423; 164/428; 164/429; 164/443

[58] Field of Search ..... 164/423, 428, 427, 429, 164/435, 443, 463, 480, 479, 485

[56] References Cited

U.S. PATENT DOCUMENTS

| | | | |
|---|---|---|---|
| 4,307,771 | 12/1981 | Draizen et al. | 164/423 X |
| 4,537,239 | 8/1985 | Budzyn et al. | 164/423 |
| 4,565,237 | 1/1986 | Draizen et al. | 164/423 X |
| 4,565,240 | 1/1986 | Shibuya et al. | 164/480 |

FOREIGN PATENT DOCUMENTS

| | | | |
|---|---|---|---|
| 56-68559 | 6/1981 | Japan . | |
| 57-112954 | 7/1982 | Japan . | |
| 58-47541 | 3/1983 | Japan | 164/423 |
| 59-42160 | 3/1984 | Japan | 164/423 |
| 59-54445 | 3/1984 | Japan . | |
| 59-163057 | 9/1984 | Japan | 164/428 |
| 59-229263 | 12/1984 | Japan . | |
| 60-33857 | 2/1985 | Japan | 164/428 |
| 61-38745 | 2/1986 | Japan | 164/428 |
| 61-189854 | 8/1986 | Japan | 164/443 |

*Primary Examiner*—Nicholas P. Godici
*Assistant Examiner*—J. Reed Batten, Jr.
*Attorney, Agent, or Firm*—Balogh, Osann, Kramer, Dvorak, Genova & Traub

[57] ABSTRACT

Cooling rolls which receive a falling stream of a metal melt, and rapidly cooling and solidifying it. Each of the cooling rolls comprises a roll base body and a sleeve which is fitted around a barrel periphery of the roll base body and forms a cooling water flow path between the roll base body and the sleeve. The sleeve is only partially tightly fixed to the roll base body. End portions of the sleeve are joined to the roll base body in such a soft structure that movement of the sleeve in the roll axial direction due to the thermal expansion is not interrupted at end portions of the sleeve.

4 Claims, 3 Drawing Sheets

COOLING ROLLS FOR PRODUCING RAPIDLY SOLIDIFIED METAL STRIP SHEETS

BACKGROUND OF THE INVENTION (1) Field of the Invention

The present invention relates to cooling rolls for producing rapidly solidified metal strip sheets. More specifically, the invention is aimed at advantageously producing sound strip sheet products by reducing to the utmost a heat crown inevitably occurring at the outer peripheral surface of the cooling roll during cooling-solidification step of a molten metal.

(2) Related Art Statement

A technique for continuously obtaining rapidly solidified metal strip sheets by directly feeding a molten metal to a surface of a cooling roll and rapidly cooling and solidifying it has widely been used as a method for producing amorphous alloys by means of a single roll or a method of rapidly solidifying a liquid by using double rolls.

However, since the molten metal is cooled to not more than its solidification point or not more than its crystallization temperature by rapidly extracting heat from the molten metal, the temperature of the outer peripheral surface of the roll with which the molten steel is brought into contact increases, and the cooling roll consequently thermally expands. At that time, a temperature gradient is developed in an axial direction of the roll between a contacting portion and a non-contacting portion with the molten metal, so that the roll surface is deformed in a barrel-like shape having a larger curvature to form a so-called heat crown.

In the rapidly liquid-solidifying method using a single roll, a nozzle having a narrow slit-like shape is generally used, and its tip is approached to the surface of the roll at a narrow spatial distance range of about 0.1 to 0.5 mm. Thus, when the dimension of the nozzle slit, the peripheral speed of the roll, and a pressure for injecting the molten metal are set constant, the thickness of the strip sheet is largely influenced by the gap between the nozzle and the roll. Therefore, if a heat crown is formed at the outer peripheral surface of the roll, the gap between the nozzle and the roll becomes narrower at the widthwise central portion of the strip sheet. Accordingly, there occurs an inconvenience that the thickness of the strip sheet is smaller at its central portion and larger at the end portions.

In order to solve thickness variations in strip sheets due to the above heat crown, Japanese Patent Application Laid-open Nos. 56-68,559, 59-54,445, 57-112,954 and 58-135,751 proposed techniques by which a temperature distribution is uniformized by varying cooling power between the central portion and the end portions of the roll with due consideration of number, dimension and shape of cooling channels to enhance the cooling power at the widthwise central portion of the sleeve as compared with that at the end portions thereof, thereby preventing occurrence of the heat crown. Each of these techniques may be called a method of increasing an amount of heat to be extracted from the widthwise central portion of the roll by relatively increasing an amount of cooling water or a cooling area at the widthwise central portion of the sleeve as compared with the end portions thereof.

However, since the above method is obliged to exchange the cooling roll when the width of strip sheets to be produced varies, and as mentioned later, even if the temperature distribution is made uniform in the roll axial direction, this does not mean that thermal expansion is uniformized and the crown heat is diminished.

Japanese Patent Application Laid-open No. 59-229,263 proposed a technique of mechanically grinding off thickness difference, due to the thermal expansion, between the widthwise central portion and end portions of the roll. However, although such a technique is not impossible as an idea basis, a large size equipment provided with a precision machine is not only necessary, but also this technique is an impractical method necessitating a precision polishing of the rolled surface during pouring the molten metal. Thus, it is actually inapplicable.

Japanese Patent Publication No. 60-51,933, now Japanese Pat. No. 1,327,971 (U.S. patent application No. 115,517, filed on Jan. 25, 1980, now U.S. Pat. No. 4,307,771) proposed a technique in which cooling channels are formed inside a metal sleeve in parallel with a roll axial direction to make the thermal expansion in the roll radial direction constant and to lessen the heat crown. In this technique, it is necessary to provide a plurality of the cooling water channels in parallel with the roll axial direction and spaced at an interval in a circumferential direction, and a cooling water stay portion on a water feed side and a cooling water stay portion on a water discharge side in axial ends of a wheel. Therefore, a fixing mechanism naturally becomes necessary at the wheel central portion.

However, this technique places its emphasis upon a radial heat expansion of the wheel and an accompanying radial thermal stress only, but it utterly fails to consider importance of the thermal expansion in the roll axial direction which the present invention makes much of. Furthermore, the fixing mechanism at the wheel central portion becomes complicated and a high dimensional precision is also required in the fitting portions between the inner surface of the wheel and the shaft end portions. Thus, extremely precision machining becomes necessary. In addition, this technique has a disadvantage that heat expansion is not improved to a satisfactory degree despite of the high machining technique and high cost.

As mentioned above, in the case of the single roll method, the cooling roll is deformed in a barrel-like shape during the casting process, and a gap between the nozzle and the roll becomes narrower at the widthwise central portion of the strip sheet. As a result, the products becomes thinner at the central portion thereof.

Needless to speak of amorphous alloy strip sheets, it is extremely difficult to relatively correct the thickness distribution of the strip sheet in the widthwise direction during a succeeding rolling, etc.

In the above-mentioned Japanese Patent Publication No. 56-68,559 and Japanese Patent Application Laid-open Nos. 59-54,445, 57-112,954 and 58-135,751, control is made such that the temperature distribution in the roll axial direction may be uniformized over the whole width of the strip sheet by appropriately devising the water cooling structure inside the cooling roll. In other words, these techniques are based on the assumption that if the temperature distribution is uniform, the amount of the thermal expansion becomes uniform so that no heat crown occurs.

However, it was confirmed through close examinations of the heat crown-occurring mechanism in experiments and computer simulations that this assumption is extremely insufficient and that heat crown cannot be suppressed to a satisfactorily low degree by uniformly controlling the temperature distribution. That is, it was experimentally and thorough the simulations that when rapidly solidified metal strip sheets were cast by using a cooling roll as shown in FIG. 2 in which heat insulating portions are formed in a roll axial direction by cutting deep grooves in the sleeve apart by 3 mm outside a strip sheet of 100 mm width to make a heat flow flux from the surface of the sleeve flow in the roll radial direction only, the temperature on the surface of the sleeve is highly uniform inside the deep grooves. However, the amount of the thermal expansion and the thickness distribution of the rapidly solidified metal strip sheet produced as measured at the same time were almost the same as in a case using a rapidly cooling roll of an ordinary type in which the sleeve surface temperature becomes higher at the center in the roll axial direction. Thus, extremely insufficient results only could be obtained.

From the above experimental facts, it was concluded that the heat crown problem could not effectively be solved by the prior art techniques having noted the surface temperature of the roll only.

SUMMARY OF THE INVENTION

The present invention has been developed in view of the above-mentioned circumstances, and is aimed at a provision of a cooling roll for the production of rapidly solidified metal strip sheets, which cooling roll can reduce to the utmost the heat crown occurring at the outer peripheral surface of the cooling roll during the rapidly cooling solidification and effectively give good quality rapidly solidified strip sheets having no variations in thickness.

According to the present invention, there is provided a cooling roll which is adapted to produce rapidly solidified metal strip sheets by receiving a falling stream of a metal melt, and forcedly cooling, solidifying it, and comprises a roll base body and a sleeve fitted around a barrel periphery of the roll, while a cooling water flow path is formed between the roll base body and the sleeve, wherein the sleeve is only partially tightly fixed to the roll base body and end portions of the sleeve are joined to the roll based member in such a soft structure that does not interrupt the movement of the sleeve in an axial direction of the roll at the end portions of the sleeve due to the thermal expansion.

These and other objects, constituent features and advantages of the present invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein:

FIG. 1(*d*) is a sectional view of a modification of the present invention;

DETAILED DESCRIPTION OF THE INVENTION

Figure 1A:
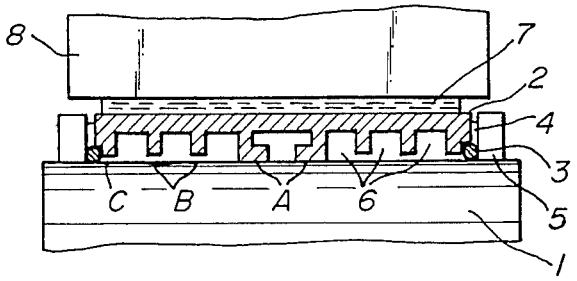
FIGS. 1(*a*) through 1(*c*) are sectional views showing structures of cooling rolls according to the present invention.
Figure 1B:
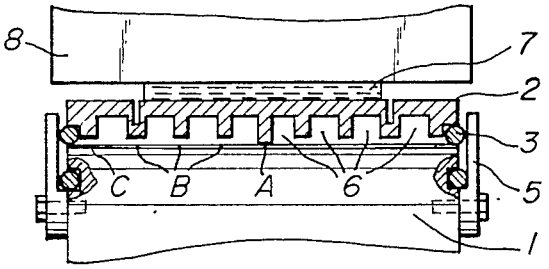
Figure 1C:
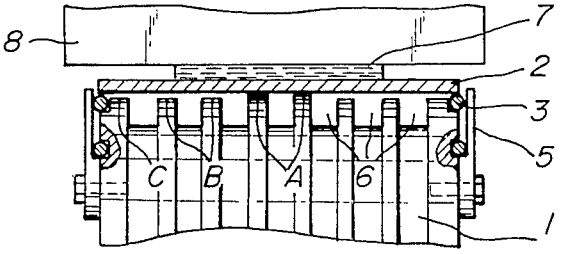
Figure 1D:
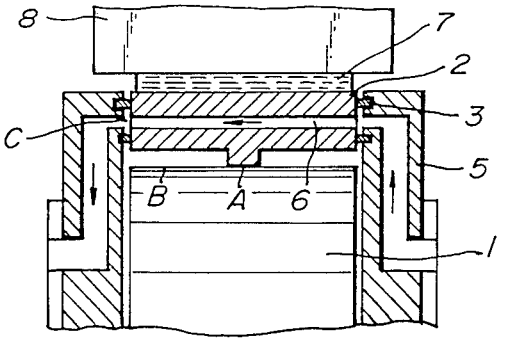

First, the history of the present invention will be explained.

When a molten metal is rapidly solidified upon being contacted with a surface of a cooling roll, the roll itself gradually reaches higher temperatures unless heat extracted from the molten metal is transferred into cooling water. Consequently, it becomes impossible to cool fresh molten metal succeedingly fed.

Therefore, in order to effectively cool the molten metal, the roll is preferably designed as a double structure consisting of a roll base body and a metallic sleeve in that an internal water cooling structure is ensured, a metal having higher heat conductivity which is advantageous in extracting heat is used in the surface of the roll, and the outer peripheral surface is easy to exchange or repair against its wearing.

The present invention is aimed at preventing of occurrence of the heat crown due to heat expansion by making the sleeve upon which the molten metal is injected substantially nonrestraint from the roll base body excluding its central portion in the roll axial direction.

The inventors' detailed analysis revealed that the heat crown that the sleeve outer periphery is deformed in a barrel-like shape owing to thermal expansion is caused by the fact that the outer peripheral side of the sleeve swells because the thermal expansion in the roll axial direction is mechanically restrained at a boundary between the sleeve and the roll base body or at ends of the sleeve rather than the fact that the amount of the radial thermal expansion varies in the roll axial direction due to the temperature distribution of the roll surface in the roll axial direction.

Based on the above analysis, the present inventors have newly developed a cooling roll structure which could restrain a swelling in a roll radial direction, that is, toward an outer peripheral side of the sleeve by releasing the thermal expansion of the metallic sleeve in the roll axial direction without restraining the axial thermal expansion of the sleeve at axial end portions thereof and allow only the essential radial thermal expansion toward the outer peripheral side of the sleeve. Thus, they have accomplished the present invention.

That is, the present invention relates to a cooling roll which is adapted to produce rapidly solidified metal strip sheets by receiving a falling stream of a metal melt, and forcedly rapidly cooling, solidifying it, and comprises a roll base body and a sleeve fitted around the barrel periphery of the roll base body and forming a cooling water flow path between the sleeve and the roll base body, wherein the sleeve is only partially tightly fixed to the roll base body, and joined to the roll base body at end portion of the sleeve in such a soft structure that movement of the sleeve in the roll axial direction due to the thermal expansion may not be interrupted at the end portions of the sleeve. Preferably, the central portion of the sleeve (about $\frac{1}{3}$ of the metallic sleeve at the central portion) is employed as the tightly fixing portion of the sleeve to the roll base body. [The term "tightly fixing portion (or length)" is used throughout the specification and claims to mean a portion (length) at which the sleeve is tightly fixed to the roll base body].

In the following, the present invention will be explained with reference to the attached drawings.

In FIGS. 1(*a*) through 1(*c*) are shown in section structures of preferable embodiments of the cooling rolls according to the present invention.

Reference numerals 1 and 2 are a roll base body and a sleeve which may be made of copper or a copper base alloy, respectively. The sleeve 2 is fitted around the roll base body 1.

The sleeve 2 is tightly fixed to the roll base body 1 through shrinkage fitting or the like at a part thereof, for example, at a central portion "A" only in FIG. 1. On the other hand, the sleeve is joined to the roll base body 1 at "B" from "A" toward the roll axial end and "C" as the sleeve end portion in a soft structure in which the sleeve 2 is in no contact with the roll base body 1. That is, a sealing member 3 such as an O-ring or a gasket prevents cooling water from leaking at the sleeve end portions C, while it absorbs the expansion in the sleeve axial direction together with a buffer plate 4. The sealing member 3 is supported by a side guide 5 attached to the end portion of the roll base body 1.

Reference numerals 6, 7 and 8 are a cooling water channel, a metal melt, and a pouring nozzle, respectively.

In FIG. 1(*a*), the sleeve 2 is tightly fixed to the barrel periphery of the roll base body at the center by means of two flanges inward projecting from the inner peripheral surface of the sleeve 2. In FIG. 1(*b*), the sleeve is tightly fixed around the roll base body by one inner peripheral projection. In FIG. 1(*c*), a cooling water path is formed around the roll base body and the sleeve is tightly fixed around the roll base body by two flanges.

As a tightly fixing method, shrinkage fitting is particularly advantageously employed among others. However, the invention is not restricted to it. The roll base body and the sleeve may be joined together by using a key or mechanically.

In order to prevent heat from dissipating into air through the end faces of the sleeves 2 and make the temperature distribution uniform in the sleeve axial direction, it is particularly preferable that as shown in FIG. 1(*a*), the buffer plate 4 having high heat insulating effect is inserted between the end face of the sleeve 2 and the side guide 5. As such a heat insulating material, asbestos or Teflon is preferable.

In FIG. 1(*d*) is shown a modification of the cooling roll according to the present invention. This embodiment is constituted such that a cooling water path is provided inside the metallic sleeve and water is fed or discharged from the sides. In this embodiment, the sleeve is also tightly fixed to the roll base body at the center portion only by shrinkage fitting.

Next, effects obtained when the cooling rolls according to the present invention were used will be explained below with reference to the following experimental data.

Figure 2:
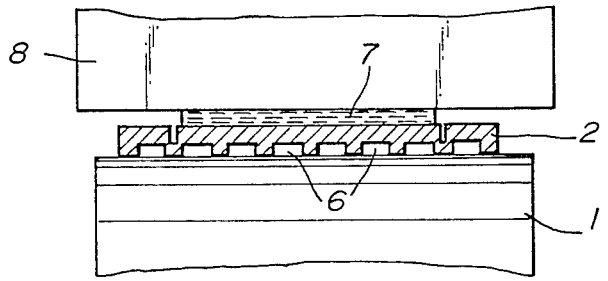
FIG. 2 PRIOR ART
FIG. 2 is a sectional view of the structure of a conventional cooling roll.
Figure 3:
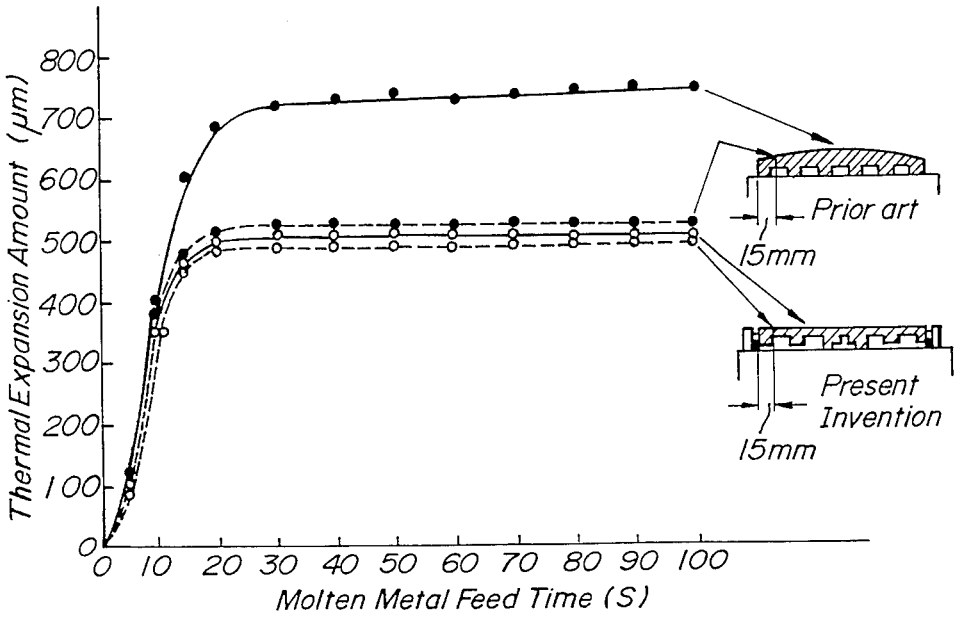
FIG. 3 is a graph in which amounts of thermal expansion on the roll surfaces are compared between the cooling roll of the present invention and that in the prior art.

By using the cooling roll with the sleeve structure shown in FIG. 1(*a*) according to the present invention and the conventional cooling roll shown in FIG. 2, change in thermal expansion with the lapse of time were examined when rapidly solidified strip sheets were actually produced, and results are shown in FIG. 3 for comparison purpose. At that time, a width of a nozzle slit for ejecting the molten metal and a width of the sleeve were set at 100 mm and 105 mm, respectively.

In the conventional sleeve shrinkage fitting structure, difference in an amount of thermal expansion between the sleeve central portion and a portion apart toward the central portion by 15 mm from the end, that is, a heat crown, was about 220 μm and the sleeve was deformed in a barrel-like shape. To the contrary, when the cooling roll according to the present invention was used, the value was as small as about 20 μm. Thus, according to the present invention, the heat crown was reduced to not more than 1/10 time that of the conventional case.

It is clear that the sleeve axial end-nonrestraint method according to the present invention has extremely high effect to restrain the heat crown of the cooling roll.

What is intended by the present invention is that the heat crown is eliminated by absorbing the expansion of the sleeve in the axial direction. The heat crown can be suppressed to an extremely small level by only partially tightly fixing the sleeve to the roll base body.

In the prior art technique, heat extracting effect has been improved by feeding a large amount of cooling water of not less than 100 $m^3$/hr to lower the roll surface temperature and reduce the amount of thermal expansion. On the other hand, according to the present invention, even if the amount of cooling water for cooling the sleeve is lessen to a remarkably smaller level as compared with the prior art technique, for instance, around 3 to 5 $m^3$/hr, an absolute value of the thermal expansion will becomes larger, but the difference in thermal expansion between the central portion and the end portions of the sleeve, that is, the heat crown, is smaller, so that variations in the thickness of the resulting products was not more than 2 μm. As mentioned above, the present invention also has an advantage that such a large amount of cooling water as required in the prior art technique is not necessary.

Further, it was revealed that when a gap between partitions of the sleeve and the outer periphery of the roll base body is not more than 1 mm in the nonrestraint zones in the cooling roll structure, cooling water preferentially flows through the cooling water channel. If the gap is more than 1 mm, an amount of the cooling water passing through the gap increases so that the cooling water is difficult to flow through the cooling water channel. Thus, it is preferable to suppress the gap at the cooling water partitions between the sleeve and the roll base body to not more than 1 mm. Furthermore, it is necessary that the distance between the axial end of the sleeve and the side guide is set at not more than a value of $(\Delta T \times \alpha \times l)/2$ in which $\Delta T$, $\alpha$ and $l$ are a maximum temperature of the sleeve, a coefficient of linear thermal expansion of the sleeve and the axial length of the sleeve, respectively. If the width of the seal at the sleeve end face can be increased, the space may be arbitrarily increased.

Figure 4:
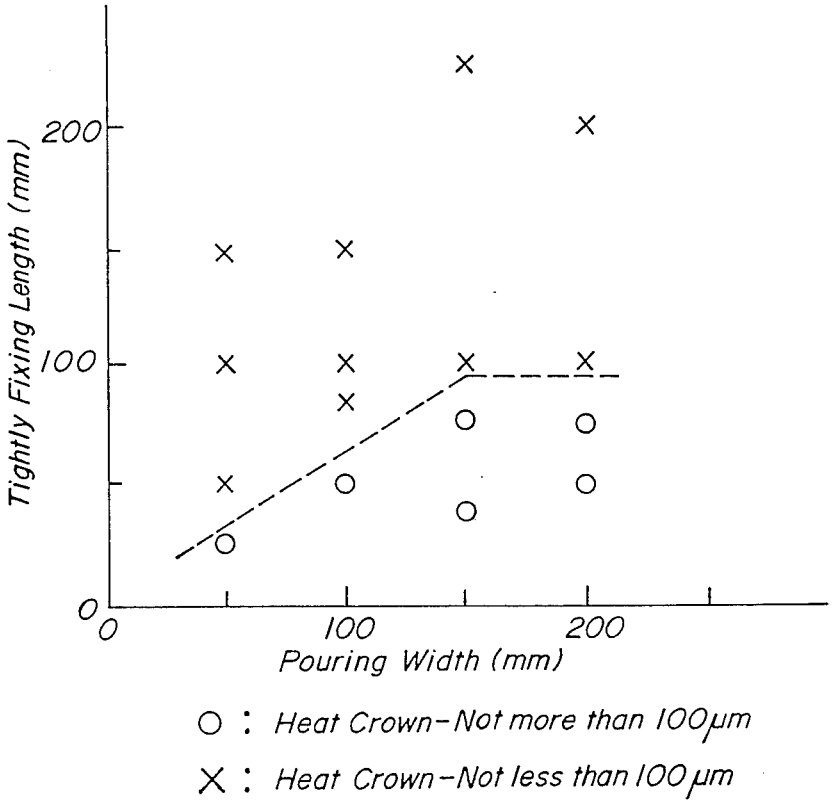
FIG. 4 is a graph illustrating influences of a tightly fixing length upon the heat crown as relation between the tightly fixing length and a pouring width.

Next, influences of the tightly fixing length upon the heat crown were examined, and results are shown in FIG. 4 as relation between the tightly fixing length and the width of a poured melt.

As evident from FIG. 4, when the tightly fixing length between the roll base body and the sleeve exceeds 60% of the width of the rapidly cooled strip sheet products, heat crown cannot fully be eliminated. For instance, when a rapidly solidified metal strip sheet of 100 mm in width is produced according to the single roll method and the tightly fixing length exceeds 60% of the width of the strip sheet, the heat crown is 100 μm or more and difference in the thickness of the products is 3 μm or more.

It was also revealed that when strip sheets having a width of 200 mm or more were produced and the tightly fixing length exceeds 100 mm, crown heat exceeds 100 μm even if the tightly fixing length is less than 60% of the width of the product.

Therefore, it is preferable that the tightly fixing length between the sleeve and the roll base body is not more than 60% of the width of the rapidly solidified metal strip sheet, and is about 100 mm at the maximum.

As mentioned in the foregoing, the present invention is different from the prior art techniques, and is mainly aimed at release of the heat expansion in the roll axial direction. The present invention has been studied from this standpoint of view. The heat crown was extremely effectively suppressed by making the axial end portions of the metallic sleeve substantially free from restraint of the roll base body, while variations in the thickness could be reduced to an almost ignorable level.

According to the present invention, the temperature distribution of the surface of the cooling roll in the roll axial direction is made uniform so that heat crown is further reduced. For, the distribution of the amount of the thermal expansion in the roll radial direction is uniformized in the roll axial direction.

More particularly, it may be that deep grooves serving as a portion of effectively insulating heat in the roll axial direction are provided just outside of a pouring portion as shown in FIG. 1(*b*) or a heat insulating plate such as an asbestos plate is inserted between the metallic sleeve and the side guide.

The present invention will be explained in more detail with reference to the following example. It is given merely in illustration of the invention, but should never be interpreted to limit the scope of the invention.

EXAMPLE 1

By using a cooling roll constructed in FIG. 1(*a*) in which the length of the sleeve in the roll axial direction was set at 155 mm and the tightly fixing length in the center portion was 40 mm, a molten metal was ejected to the surface of the cooling roll through a nozzle slit over a width of 150 mm and an Fe—B—Si base amorphous alloy strip sheet was produced according to a single roll method.

A heat crown at the outer peripheral surface of the sleeve during the injection (expressed by difference in thermal expansion between the central portion and the portion located by 15 mm toward the central portion from the edge portion) was as small as 40 μm. At that time, the average thickness of the strip sheet was 21 μm with a longitudinal deviation of ±1 μm and a thickness difference of as extremely small as 2 μm.

COMPARATIVE EXAMPLE 1

By using a conventional cooling roll constituted in FIG. 2 in which the length of a sleeve in a roll axial direction was 200 mm and the sleeve was restrained by the cooling roll over its entire width excluding cooling channels, an Fe—B—Si base amorphous alloy strip sheet was prepared in the same manner as in Example 1.

A heat crown at the outer peripheral surface of the sleeve during the injection was as large as 350 μm. At that time, the thickness of the resulting strip sheet was 16 μm at the widthwise central portion, and 25 μm at the edge portion with thickness difference of as large as 9 μm. Further, numerous holes penetrating the widthwise center portion of the strip sheet over the entire thickness were formed.

In the above embodiments, explanation has mainly been made of cases where the sleeve is tightly fixed to the roll base body at the central portion thereof. However, the invention is not restricted particularly to any tightly fixing location so long as the thermal expansion in the roll axial direction of the sleeve may be released. For instance, it was confirmed that the same effects could be obtained when the sleeve was tightly fixed to the roll base body at a location apart from the end by $\frac{1}{4}$ of the length of the sleeve or it was tightly fixed near the end portion of the sleeve.

As having been described in the above, according to the present invention, the deformation of the cooling roll in a barrel-like shape due to the heat crown during the production of the rapidly solidified metal strip sheets is solved by a completely novel method different from the conventional technique, that is, by releasing the thermal expansion of the sleeve in the roll axial direction while the axial end portions of the sleeve are substantially nonrestraint from the roll base body. Thus, the deviation in the thickness in the strip sheets can largely be reduced without necessitating complicated changes in the roll structure. Therefore, a huge interest can be obtained in the industrial field.

What is claimed is:

1. A cooling roll adapted to produce rapidly solidified metal strip sheets by receiving a falling stream of a metal melt, and rapidly cooling and solidifying it, said cooling roll comprising a roll base body and a sleeve which is fitted around a barrel periphery of the roll base body and forms a cooling water flow path between the roll base body and the sleeve, wherein the sleeve is only partially tightly fixed to the roll base body and end portions of the sleeve are joined to the roll base body such that the movement of the sleeve in the roll axial direction due to thermal expansion is not interrupted at the end portions of the sleeve.

2. A cooling roll according to claim 1, wherein a portion at which the sleeve is tightly fixed to the roll base body is a central portion of the sleeve.

3. A cooling roll according to claim 1, wherein a length of the position at which the sleeve is tightly fixed to the roll base body is not more than 60% of a width of the rapidly solidified metal strip sheet, and the width of the rapidly solidified metal strip sheet is not more than 100 mm.

4. A cooling roll according to claim 2, wherein a length of the position at which the sleeve is tightly fixed to the roll base body is not more than 60% of a width of the rapidly solidified metal strip sheet, and the width of the rapidly solidified metal strip sheet is not more than 100 mm.

* * * * *